United States Patent [19]

Overton

[11] 4,019,477

[45] Apr. 26, 1977

[54] DUEL FUEL SYSTEM FOR INTERNAL COMBUSTION ENGINE

[76] Inventor: Delbert L. Overton, 9011 Hibben Ave., Indianapolis, Ind. 46229

[22] Filed: July 16, 1975

[21] Appl. No.: 596,514

[52] U.S. Cl. ..... 123/127; 123/179 G; 261/18 A; 261/23 A; 261/41 R

[51] Int. Cl.[2] ..... F02M 13/04

[58] Field of Search ..... 123/127, 179 G, 198 A; 261/23 A, 41 R, 41 A, 41 C, 41 D, 18 A, 18 R

[56] References Cited

UNITED STATES PATENTS

| | | | |
|---|---|---|---|
| 1,552,995 | 9/1925 | McKenzie-Martyn | 123/127 |
| 2,430,693 | 11/1947 | Udale | 123/127 |
| 2,715,392 | 8/1955 | Grevas | 123/127 X |
| 3,805,756 | 4/1974 | Madariaga | 123/127 |

*Primary Examiner*—Wendell E. Burns
*Attorney, Agent, or Firm*—Woodard, Weikart, Emhardt & Naughton

[57] ABSTRACT

In addition to the gasoline-air mixing primary carburetor on an internal combustion engine, an auxiliary carburetor is provided for mixing air and alcohol, to thereby provide a substantial portion of the fuel-air mixture used by the engine during idle conditions and light-load conditions, while the primary carburetor provides an increasingly greater portion of the total fuel-air mixture during high-load conditions. The alcohol fuel-air mixture flows directly to the intake manifold, thus by-passing the throttle valve which controls the fuel-air mixture from the primary carburetor. The auxiliary carburetor is vacuum controlled.

13 Claims, 1 Drawing Figure

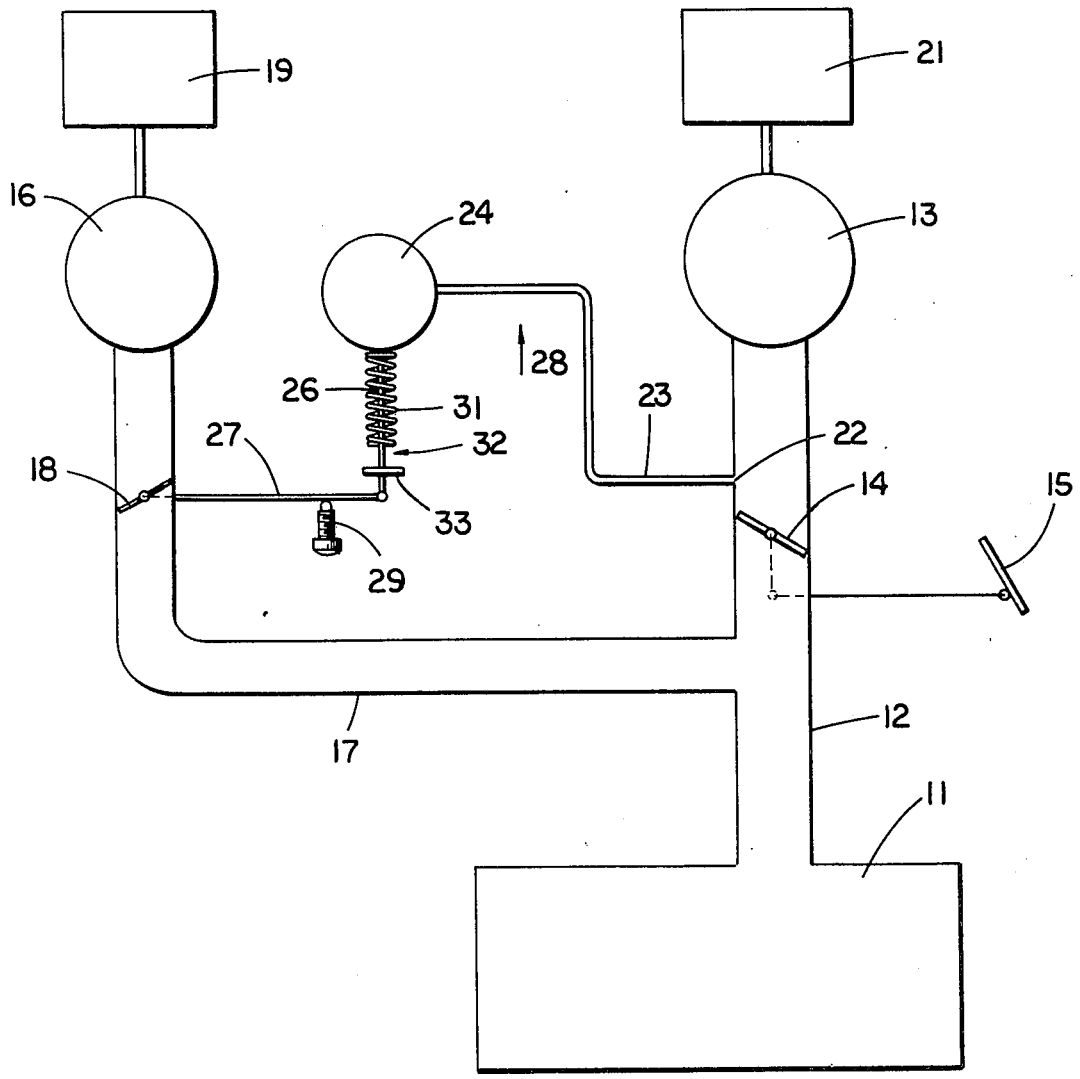
19
21
16
24
13
28
26
31
23
27
32
22
18
14
15
33
29
12
17
11

DUEL FUEL SYSTEM FOR INTERNAL COMBUSTION ENGINE

BACKGROUND OF THE INVENTION

1. Field of the Invention

This invention relates generally to internal combustion engines, and more particularly to naturally aspirated (in contrast to supercharged) engines typically using gasoline as the fuel, but which use a different fuel for certain load conditions.

2. Description of the Prior Art

Much has been done in connection with fuel systems for internal combustion engines. Various ways and means have been provided to use fuels other than gasoline, in addition to the gasoline-air mixture entering the combustion cylinders. A U.S. Pat. No. 2,675,788 to Porter discloses an injector for a liquid, which might conceivably introduce alcohol into the carburetor or intake manifold of an engine. Devices have been proposed for injecting water. Other United States patents of which I am aware and generally relating to the matter are as follows:

| Patent No. | Patentee | Issue Date |
|---|---|---|
| 2,474,083 | Zimmerman | June 21, 1949 |
| 2,482,102 | Dahle | Sept. 20, 1949 |
| 2,533,863 | Wirth | Dec. 12, 1950 |
| 2,554,612 | Bills | May 29, 1951 |
| 2,675,788 | Porter | April 20, 1954 |
| 2,676,577 | Vanderpoel | April 27, 1954 |

It is well-known that the fossil-fuels of the petroleum-based type have become increasingly scarce and expensive. In addition, combustion thereof tends to pollute the atmosphere. In contrast, fuels such as alcohol are readily obtainable in large quantities, although heretofore somewhat more expensive than gasoline, for example. Alcohol more readily lends itself to low pollution combustion in an internal combustion engine than does gasoline. It is also desirable to be able to use engines with more efficient compression ratios, lower rotational speeds, and without supercharging. The present invention is an effort to meet the needs here indicated.

SUMMARY OF THE INVENTION

Described briefly, in a typical embodiment of the present invention, means for vaporizing alcohol or some other readily available, clean burning fuel, are provided in parallel with the normal gasoline vaporizing means of an internal combustion engine, and arranged to provide a substantial portion of the required fuel-air mixture to the engine under idle and low-load conditions of the engine, with greater supplementation from the gasoline fuel-air vaporizing means for high-load conditions.

BRIEF DESCRIPTION OF THE DRAWING

The drawing is a schematic diagram of an internal combustion engine with a typical embodiment of the present invention incorporated therein.

DESCRIPTION OF THE PREFERRED EMBODIMENT

Referring now to the drawings in detail, internal combustion engine 11 is provided with an intake manifold 12 supplied with a gasoline-fueled, fuel-air mixture from a carburetor 13 having throttle valve 14 therein, controlling admission of the fuel-air mixture from the carburetor 13 to the intake manifold. This carburetor may hereinafter be referred to as the "primary" carburetor, as it may be one typically used as original equipment on current production internal combustion engines for automotive use with gasoline in the United States and elsewhere. The throttle valve 14 is conventionally controlled by linkage connected to an accelerator pedal 15 in the vehicle.

According to a typical embodiment of the present invention, another carburetor 16 is also connected to the intake manifold and, although a conduit 17 is shown between the throttle blade 18 of that carburetor and intake manifold, it could actually be mounted directly to the intake manifold or even be employed as a side-by-side arrangement with the primary carburetor, or the functions of the two carburetors 13 and 16 could be incorporated in a single assembly. However, in this instance, the fuel supplied to a carburetor 16 is alcohol in the typical embodiment, represented schematically by the showing of an alcohol reservoir 19, in contrast to the gasoline reservoir 21 supplying the carburetor 13.

A distributor vacuum control port 22 above the throttle valve in the primary carburetor, is connected through the vacuum line 23 to a vacuum-mechanical unit 24 having a linearly movable control rod 26 projecting therefrom. Rod 26 is connected to the throttle shaft control arm 27. The vacuum unit 24 can be of the type having a diaphragm therein whereby, when the vacuum is high (pressure is low) in the vacuum line 23, the arm will be pulled upward in the direction of arrow 28 to open the throttle valve 18. Normally this condition exists at low-load conditions. Under the same conditions, the throttle valve 14 is nearly closed. Because the vacuum port 22 as typically found in conventional carburetors has zero vacuum imparted in the idle condition of the conventional carburetor, there is a stop screw 29 provided on the throttle control arm for the secondary carburetor so that it will remain open adequately to provide an idle mixture, even though the throttle is closed on the primary carburetor and the vacuum at vacuum port 22 is zero. Also, although the vacuum-mechanical unit 24 has a return spring 31 opposing the throttle-opening effect of increasing vacuums, the spring is arranged so that the throttle-closing spring bias does not commence until the vacuum control rod has traveled about 25% of full travel toward auxiliary throttle open position. This is represented by the space 32 between the the lower end of the compression spring 31, and the flange 33 secured to the control rod 26.

During most operating conditions, because the vacuum is comparatively high in the line 23, the carburetor 16 will be supplying a substantial portion of the total fuel mixture, required by the engine, the greater the vacuum, the greater the opening. At about 12"Hg vacuum in line 23, the throttle opening for the auxiliary carburetor will be at its maximum. At less than 3"Hg, the auxiliary throttle will be closed to the limit of stop screw 29. Depending on the characteristics of the engine involved, the attainment of wide open throttle of the auxiliary carburetor may be established at from 7"Hg vacuum to 12"Hg vacuum.

Because of the distributor vacuum advance requirements of conventional engines, the vacuum at the vacuum control port of the carburetor (port 22 in this example) does not directly follow manifold vacuum, being initially somewhat lower at slight throttle openings. Therefore, depending on the particular carburetor being used, some adjustment may need to be made to the vacuum unit return spring for the auxiliary carburetor, for best results.

From the foregoing description, it will be recognized that a variety of types of atomizing or vaporizing devices other than carburetors might be used for the secondary carburetor. Also, they could be used with something other than a carburetor for the gasoline-air mixture, so long as some appropriate means were provided to relate the control of the secondary carburetor to the load being borne by the engine. Also, auxiliary fuels other than alcohol might be used. Benzene is an example. Various fuel combinations might also be used in the auxiliary carburetor. An alcohol-water mixture is an example.

While there have been described above the principles of this invention in connection with specific apparatus, it is to be clearly understood that this description is made only by way of example and not as a limitation in the scope of the invention.

What is claimed is:

1. A dual fuel system for an internal combustion engine comprising:

primary fuel-air mixing means to produce a primary fuel-air mixture of a primary fuel and air;

auxiliary fuel-air mixing means to produce an auxiliary fuel-air mixture of an auxiliary fuel and air;

manually operable control means to control passage of the primary mixture to an intake manifold;

a vacuum source coupled to and influenced by said control means;

auxiliary fuel flow control means coupled to said auxiliary fuel-air mixing means and to said vacuum source for enabling increased auxiliary fuel-air mixture flow to said manifold in response to increasing vacuum above 3"Hg at said vacuum source and for decreasing auxiliary fuel-air mixture flow to said manifold in response to decreasing vacuum above 3"Hg at said vacuum source but maintaining auxiliary fuel-air mixture flow to said manifold notwithstanding source vacuum less than 3"Hg.

2. The system of claim 1 wherein:

said auxiliary fuel-air mixing means are a carburetor having a fuel-air mixture outlet means;

said auxiliary fuel flow control means include a throttle valve in said outlet means and a vacuum controller coupled to said throttle valve and to said vacuum source.

3. The system of claim 2 wherein:

said vacuum source is a modified manifold vacuum source and includes a distributor vacuum port in a gasoline-air mixing carburetor and is responsive to engine idle condition to provide a vacuum not exceeding 3"Hg.

4. A dual fuel system for an internal combustion engine comprising:

primary fuel-air mixing means to produce a mixture of air and a primary fuel;

auxiliary fuel-air mixing means to produce a mixture of air and an auxiliary fuel;

manual throttle control means associated with said primary mixing means to control flow of primary fuel-air mixture to said engine;

auxiliary fuel flow control means coupled to said auxiliary mixing means and to said manual throttle control means for reducing auxiliary fuel-air mixture flow in response to movement of said manual throttle control means from partial open position and in a direction calling for more power from the engine;

said primary fuel-air mixing means including a gasoline-air mixing carburetor;

said auxiliary fuel-air mixing means including a second carburetor having a fuel-air mixture outlet means;

said auxiliary fuel flow control means including a throttle valve in said outlet means and a vacuum controller coupled to said throttle valve and to a modified manifold vacuum source;

said modified manifold vacuum source including a throttle influenced vacuum source in said gasoline-air mixing carburetor and producing vacuum of 3"Hg or less at normal engine idle;

said gasoline-air mixing carburetor having fuel-air mixture outlet means, with a throttle valve therein;

the system further comprising an internal combustion engine intake manifold means;

said fuel-air mixture outlet means of said carburetors being connected to said intake manifold means independently of each other, with the said throttle valves of said carburetors controlling admission of fuel-air mixtures therefrom directly to said manifold means exclusive of control thereof by any further throttle valve.

5. In an internal combustion engine fueled by a gasoline-air mixture from a primary carburetor to an intake manifold, with a first throttle valve manually operable between closed throttle and open throttle conditions for controlling admission of the gasoline-air mixture to the intake manifold, the improvement comprising:

auxiliary carburetor means mixing alcohol and air, said auxiliary carburetor means having mixture outlet means communicating with said intake manifold through a passageway bypassing said first throttle valve, said passageway having therein a second throttle valve controlling admission of an alcohol-air mixture to the intake manifold.

6. The improvement of claim 5 and further comprising:

auxiliary throttle control means including a vacuum-mechanical unit having an operating member coupled to said second throttle valve and having a vacuum operator connected to a vacuum source, said unit being responsive to increasing vacuum at said source to increase the opening of said second throttle valve, said second throttle valve having an idle position wherein said auxiliary carburetor is enabled to supply an alcohol-air mixture to said intake manifold.

7. The improvement of claim 6 and further comprising:

auxiliary throttle return means associated with said second throttle valve and urging said second throttle valve toward closed condition.

8. The improvement of claim 7 wherein:

said second throttle valve is operable from said idle position toward a wide-open position, said return means being inoperable on said second throttle valve during initial operation from said idle position toward wide-open position.

9. The improvement of claim 8 wherein:

said vacuum-mechanical unit is operable to move said second throttle valve from idle position at source vacuum less than 3"Hg to wide-open position in response to source vacuum in excess of 7"Hg.

10. The system of claim 2 wherein:

said vacuum source is a modified manifold vacuum source responsive to engine idle condition to provide a vacuum not exceeding 3"Hg.

11. The improvement of claim 6 wherein:

said vacuum-mechanical unit is operable to maintain, at some source vacuum in excess of 7"Hg, the maximum open position of which said second throttle valve is capable.

12. The improvement of claim 6 wherein:

said vacuum-mechanical unit is operable, in response to a maximum source vacuum greater than source vacuum at engine idle, to move said second throttle valve from said idle position to a position enabling the maximum alcohol-air mixture flow to said intake manifold.

13. In an internal combustion engine fueled by a mixture of a primary fuel and air from a primary carburetor to an intake manifold, with a first throttle valve manually operable between closed throttle and open throttle conditions for controlling admission of the primary fuel-air mixture to the intake manifold, the improvement comprising:

auxiliary carburetor means mixing an auxiliary fuel and air, said auxiliary carburetor means having mixture outlet means communicating with said intake manifold through a passageway bypassing said first throttle valve, said passageway having therein a second throttle valve controlling admission of an auxiliary fuel-air mixture to the intake manifold;

auxiliary throttle control means including a vacuum-mechanical unit having an operating member coupled to said second throttle valve and having a vacuum operator connected to a vacuum source, said unit being responsive to increased vacuum at said source to increase the opening of said second throttle valve, said second throttle valve having an idle position wherein said auxiliary carburetor is enabled to supply an auxiliary fuel-air mixture to said intake manifold;

auxiliary throttle return means associated with said second throttle valve and urging said second throttle valve toward closed condition;

said second throttle valve being operable from said idle position toward a wide-open position, said return means being inoperable on said second throttle valve during initial operation from said idle position toward wide-open position.

* * * * *